US008378770B2

(12) United States Patent
Chen et al.

(10) Patent No.: US 8,378,770 B2
(45) Date of Patent: Feb. 19, 2013

(54) INDUCTOR ASSEMBLY

(75) Inventors: Pi-Fan Chen, Taoyuan Hsien (TW); Su-Chiung Hsu, Taoyuan Hsien (TW); Zhi-Liang Zhang, Taoyuan Hsien (TW); Ming-Cheng Lee, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 13/312,203

(22) Filed: Dec. 6, 2011

(65) Prior Publication Data

US 2013/0009738 A1 Jan. 10, 2013

(30) Foreign Application Priority Data

Jul. 5, 2011 (TW) ..... 100123585 A

(51) Int. Cl.

| | |
|---|---|
| ***H01F 27/06*** | (2006.01) |
| ***H01F 27/29*** | (2006.01) |
| ***H01F 27/30*** | (2006.01) |
| ***H01F 27/38*** | (2006.01) |

(52) U.S. Cl. ..... 336/65; 336/192; 336/199; 336/208; 336/229

(58) Field of Classification Search ..... 336/65, 336/199, 208, 229, 192

See application file for complete search history.

(56) References Cited

U.S. PATENT DOCUMENTS 3,483,497 A * 12/1969 Clark et al. ..... 336/96
4,602,122 A * 7/1986 Lint ..... 174/138 G

* cited by examiner

*Primary Examiner* — Mohamad Musleh
*Assistant Examiner* — Tsz Chan
(74) *Attorney, Agent, or Firm* — Muncy, Geissler, Olds & Lowe, PLLC

(57) ABSTRACT

An inductor assembly includes a base and an inductor component. When the inductor component is disposed on the base, the distance between the inductor component and a nearby electronic component is increased by a connecting element or a carrying element of the base, and the inductor component is prevented from contacting the nearby electronic component by a spacing element of the base.

10 Claims, 5 Drawing Sheets

INDUCTOR ASSEMBLY

CROSS-REFERENCE TO RELATED APPLICATIONS

This Application claims priority of Taiwan Patent Application No. 100123585, filed on Jul. 5, 2011, the entirety of which is incorporated by reference herein.

BACKGROUND OF THE INVENTION

1. Field of the Invention

The invention relates to an inductor assembly, and in particular, to an inductor assembly having a base.

2. Description of the Related Art

For increasing power conversion efficiency and power supply ability of power supplies, massive electronic components with complex circuit designs are required to be disposed within limited spaces of power supplies. Please refer to FIG. 1, which is a schematic view of a conventional power supply. The power supply includes a printed circuit board 10*a*, a choke 20*a*, a transformer 30*a*, and a base 40*a*. The choke 20*a* and the transformer 30*a* are mounted on the printed circuit board 10*a*. Because of circuit design and space planning of the power supply, the distance between a threaded hole 11*a* and a mounting hole 12*a* on the printed circuit board 10*a* cannot be further decreased, and the relative locations of the threaded hole 11*a* and the mounting hole 12*a* cannot be further adjusted. Thus, the choke 20*a* and the transformer 30*a* are too close, and the safety regulation of power supplies is violated.

Moreover, since the base 40*a* is a plate structure, the choke 20*a* may not be stably disposed on the base 40*a*, and the base 40*a* cannot prevent the choke 20*a* and the transformer 30 from contact theretogether. It is dangerous when the choke 20*a* contacts the transformer 30*a*.

Further, when the choke 20*a* is assembled to the base 40*a*, ends of a wire 21*a* of the choke 20*a* are pulled at the same time, and an axis AX1 is located above the center of the ends of the wire 21*a*. Thus, the relative locations of the choke 20*a*, the transformer 30*a*, and the base 40*a* are fixed, and the distance between the choke 20*a* and the transformer 30*a* cannot be adjusted.

BRIEF SUMMARY OF THE INVENTION

To solve the problems of the prior art, the object of the invention is to provide an inductor assembly with a base having an L-shaped structure. The inductor component is prevented from contacting a nearby electronic component by the base, and the distance between the inductor component and the nearby electronic component is increased without changing circuit design and space planning of the inductor assembly.

For the above objective, an inductor assembly includes a base and an inductor component. The base includes a base body, a spacing element, and a connecting element. The spacing element is disposed on the base body. The connecting element is connected to the base body and the spacing element. The inductor component is disposed on the base body and is close to the spacing element.

In conclusion, the spacing element of the inductor assembly is used for preventing the inductor component from contacting the electronic component. Moreover, the inductor component is more distant from the electronic component than the prior art because of the connecting element or the spacing element. Thus, the inductor component is apart from the electronic component at a safe distance.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
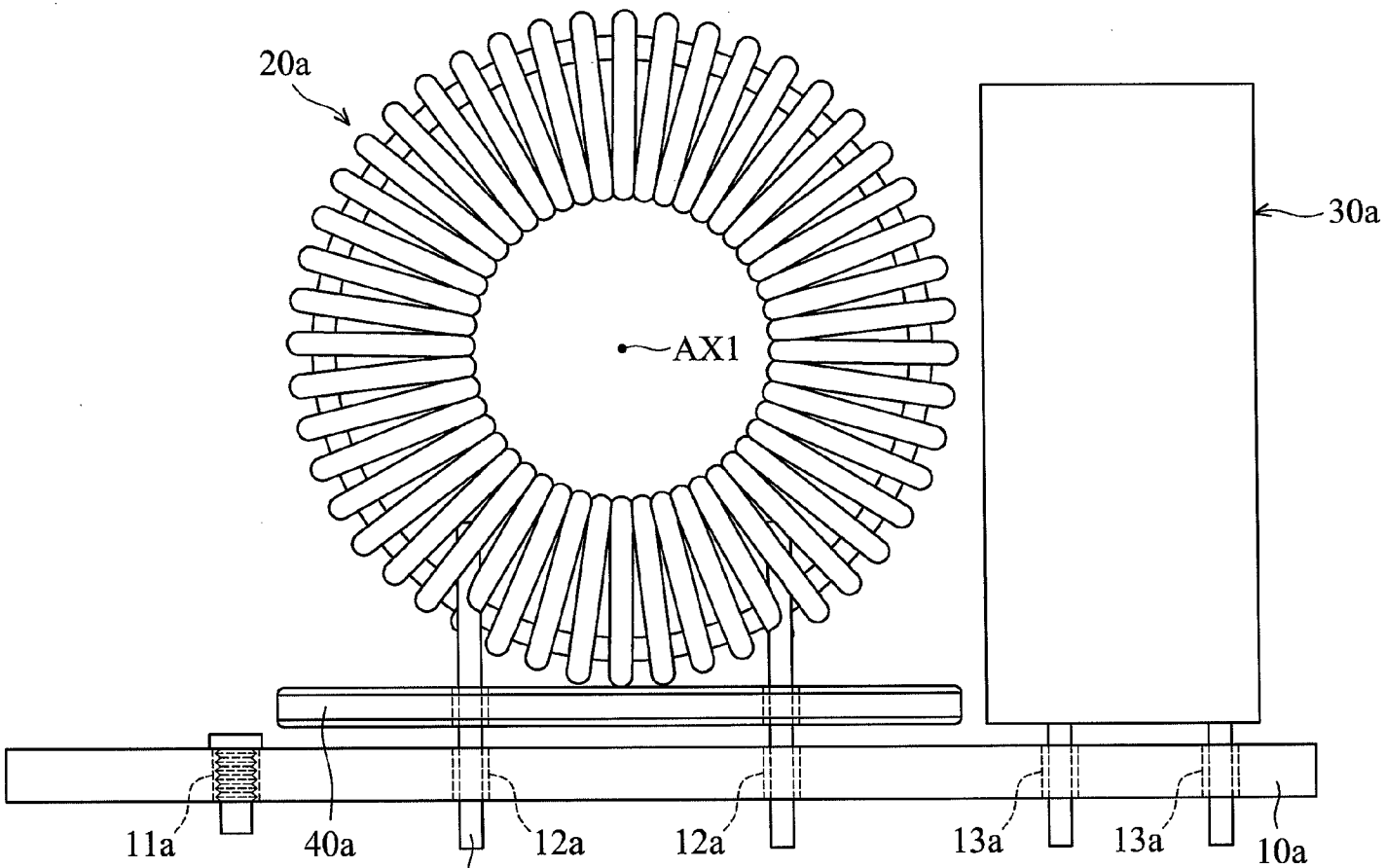
FIG. 1 ( PRIOR ART )
FIG. 1 is a schematic view of a conventional power supply.
Figure 2:
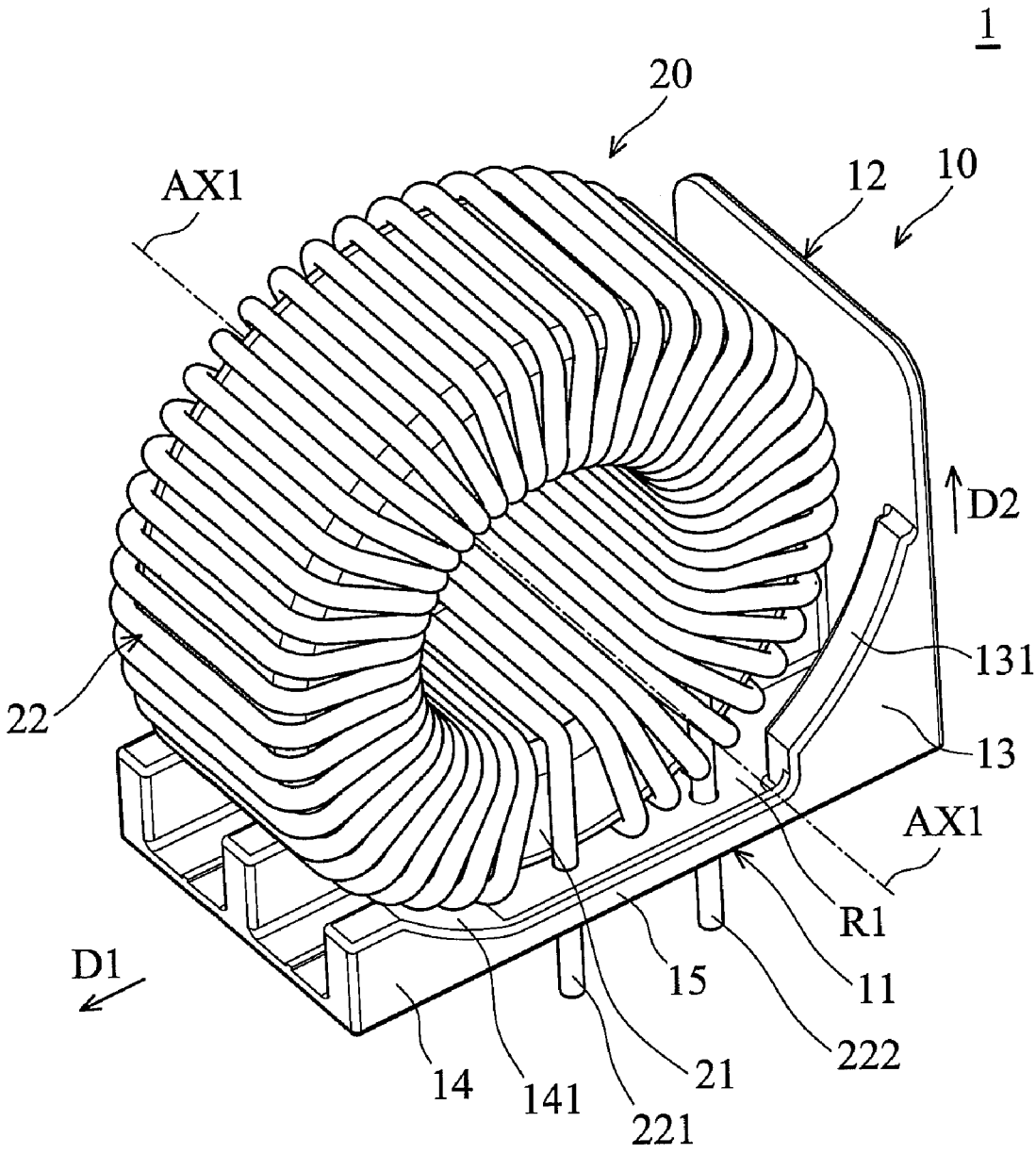
FIG. 2 is a perspective view of an inductor assembly of the invention.
Figure 3:
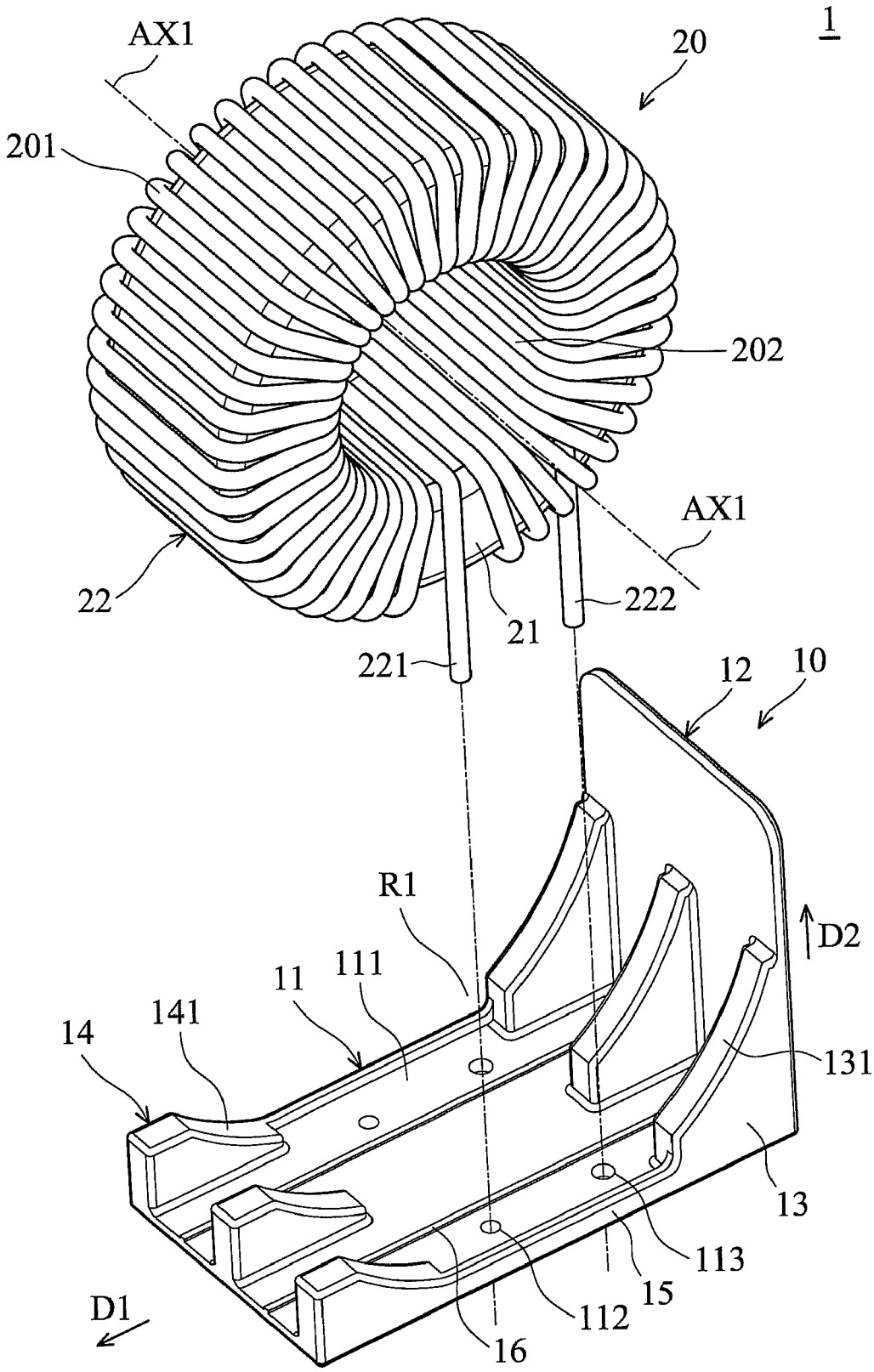
FIG. 3 is an exploded view of the inductor assembly of the invention.

Please refer to FIG. 2 and FIG. 3. FIG. 2 is a perspective view of an inductor assembly 1 of the invention. FIG. 3 is an exploded view of the inductor assembly 1 of the invention. The inductor assembly 1 includes a base 10 and an inductor component 20. The base 10 is an L-shaped structure, and made from insulated material, such as plastic. The inductor component 20 may be a choke disposed on the base 10.

The base 10 includes a base body 11, a spacing element 12, and a plurality of connecting elements 13, a plurality of carrying elements 14, a plurality of reinforcing ribs 15, and a plurality of auxiliary reinforcing ribs 16. The base body 11 is a plate structure, and is extended along a first extension direction D1. The base body 11 has a mounting surface 111, a plurality of first holes 112 and a plurality of second holes 113. The first holes 112 and the second holes 113 are formed on the mounting surface 111.

The spacing element 12 is a plate structure. The spacing element 12 is disposed on an edge of the mounting surface 111 of the base body 11, and is close to the inductor component 20. The spacing element 12 is substantially extended along a second extension direction D2 and perpendicular to the base body 11. The spacing element 12 and the base body 11 are formed as an L-shaped structure.

The connecting elements 13 are substantially trapezoid structures and disposed on the mounting surface 111 of the base body 11. The connecting elements 13 are substantially extended along the second extension direction D2 and parallel to the base body 11. Each of the connecting elements 13 has a supporting surface 131 corresponding to the inductor component 20, and thus the inductor component 20 can be stably disposed on the connecting elements 13. In the embodiment, the connecting elements 13 are connected to the base body 11 and the spacing element 12, and are located at a location where the base body 11 and the spacing element 12 are connected. Thus, the base body 11 and the spacing element 12 can be prevented from breaking due to the connecting elements 13.

The carrying elements 14 are substantially trapezoid structures, and are disposed on an edge of the mounting surface 111 of the base body 11 opposite to the connecting elements 13. The carrying elements 14 are substantially extended along the second extension direction D2 and parallel to the base body 11. Each of the carrying elements 14 has a carrying surface 141 corresponding to the inductor component 20, and thus the inductor component 20 can be stably supported by the carrying elements 14.

In the embodiment, since the thickness of the base 10 can be thinner due to the carrying elements 14 and the connecting elements 13, which are separately parallel to each other, the cost of the base 10 can be decreased. The spacing element 12, the connecting elements 13, the second holes 113, the first holes 112 and the carrying elements 14 are arranged on the mounting surface 111 of the base body 11 substantially along the first extension direction D1. Namely, the second holes 113 are located between the connecting elements 13 and the first holes 112.

The reinforcing ribs 15 are respectively disposed on two opposite edges of the mounting surface 111 of the base body 11, and are connected to the connecting elements 13 and the carrying elements 14. The auxiliary reinforcing ribs 16 are disposed on the mounting surface 111 of the base body 11. One end of each of the auxiliary reinforcing ribs 16 is located between two adjacent connecting elements 13, and is connected to the spacing element 12. The other end of each of the auxiliary reinforcing ribs 16 is located between two adjacent carrying elements 14. The reinforcing ribs 15 and the auxiliary reinforcing ribs 16 are extended along the first extension direction D1 and are separately parallel to each other. Moreover, the reinforcing ribs 15 and the auxiliary reinforcing ribs 16 are located between the inductor component 20 and the base body 11.

In the embodiment, the strength of the base body 11 is increased by the reinforcing ribs 15 and the auxiliary reinforcing ribs 16, and thus the thickness of the base body 11 is reduced and the cost of the base 10 is decreased. The inductor component 20 is located between the two reinforcing ribs 15 and is above the auxiliary reinforcing ribs 16. Since the height of the auxiliary reinforcing ribs 16 is lower than the height of the reinforcing ribs 15, the height of the inductor assembly 1 is decreased. Further, the strength of the base 10 is maintained by the reinforcing ribs 15 and the auxiliary reinforcing ribs 16.

The inductor component 20 is disposed on the base body 11 and is substantially located between the carrying elements 14 and the connecting elements 13. The inductor component 20 may contact the spacing element 12, the connecting element 13, or the carrying element 14 to be stably disposed on the base 10. Moreover, a recess R1 is formed by the mounting surface 111, the carrying element 14, and the connecting element 13, and the inductor component 20 is received in the recess R1. Thus, the height of the inductor assembly 1 is lower.

The inductor component 20 is an annular hollow structure. The inductor component 20 has an annular outer surface 201, an annular inner surface 202, and an axis AX1. The axis AX1 is substantially parallel to the annular outer surface 201, the annular inner surface 202, the base body 11, and the spacing element 120. The annular outer surface 201 of the inductor component 20 is in contact with the mounting surface 111 of the base body 11, the supporting surface 131 of the connecting element 13, and the carrying surface 141 of the carrying element 14.

The inductor component 20 includes a magnetic core 21 and a wire element 22. The magnetic core 21 is an annular hollow structure. The wire element 22 includes at least one wire, wherein the wire may be an enamel wire. In the embodiment, the wire element 22 includes two wires. The magnetic core 21 is wound by the wire element 22. The wire element 22 has a plurality of first wire ends 221 and a plurality of second wire ends 222. The first wire ends 221 are respectively passed through the first holes 112, and the second wire ends 222 are respectively passed through the second holes 113.

Figure 4:
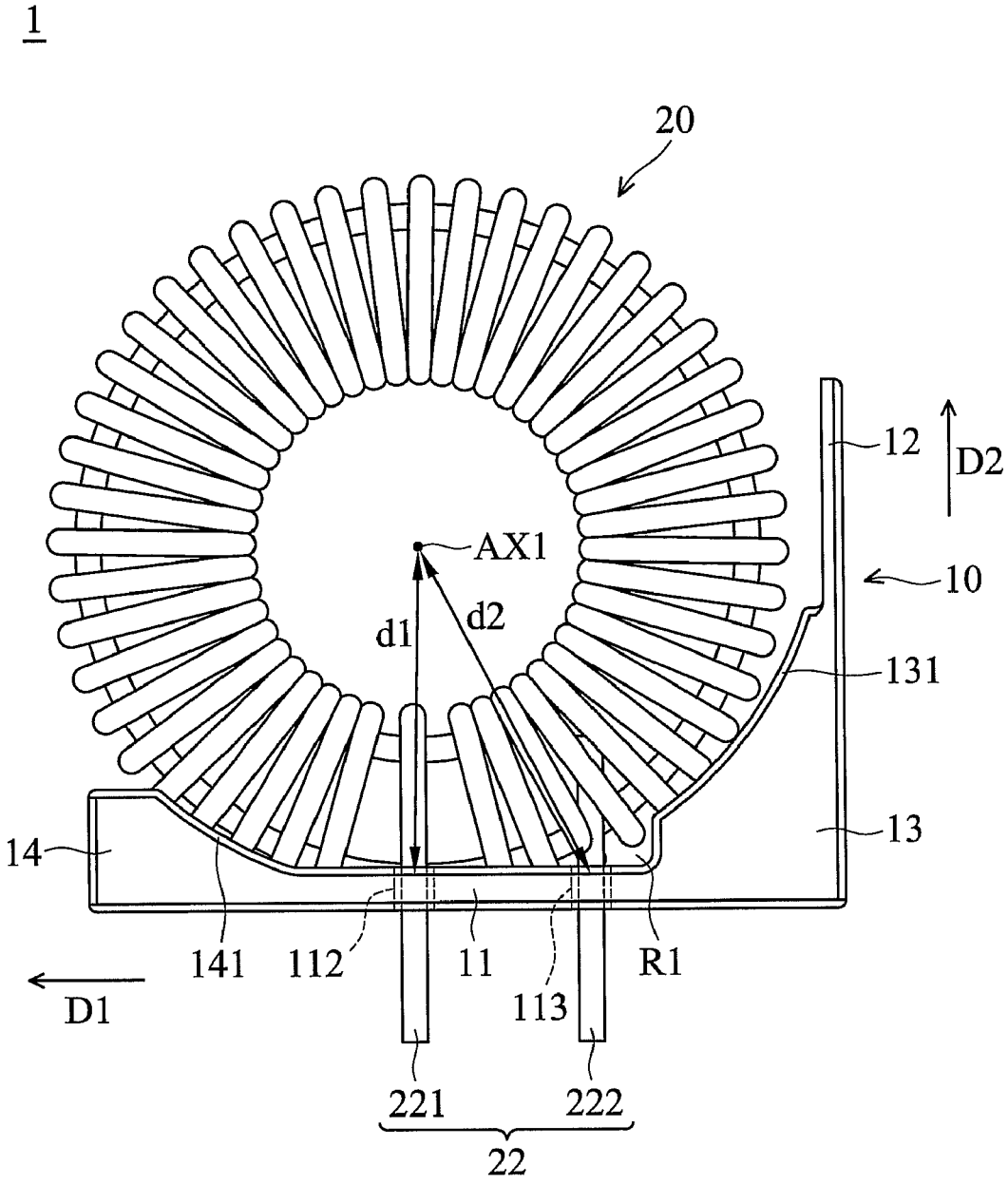
FIG. 4 is a side view of the inductor assembly of the invention.

Please refer to FIG. 4, which is a side view of the inductor assembly 1 of the invention. As shown in FIG. 4, when the inductor component 20 is assembled to the base 10, the first wire ends 221 and the second wire ends 222 of the wire element 22 pass through the base body 11. Next, the inductor component 20 is mounted between the connecting elements 13 and the carrying elements 14 by pulling the first wire ends 221 and the second wire ends 222. Thus, the relative locations between the inductor component 20 and the base 10 can be adjusted by modifying the structure of the connecting elements 13 and the carrying elements 14, and by modifying the relative locations between the connecting elements 13 and the carrying elements 14 and the relative locations between the first holes 112 and the second holes 113.

As shown in FIG. 4, when the inductor component 20 is disposed on the base 10, the axis AX1 is located above the first hole 112, and the distance dl between the axis AX1 and the first hole 112 is smaller than the distance d2 between the axis AX1 and the second hole 113. However, in the prior art, the axis AX1 should be located above the center of the first holes 112 and the second holes 113. In another embodiment, by adjusting the relative location between the inductor component 20 and the base 10, the axis AX1 is at a further distance from the spacing element 12, and the axis AX1 passes through an area above the first holes 112 in the first extension direction D1.

Figure 5:
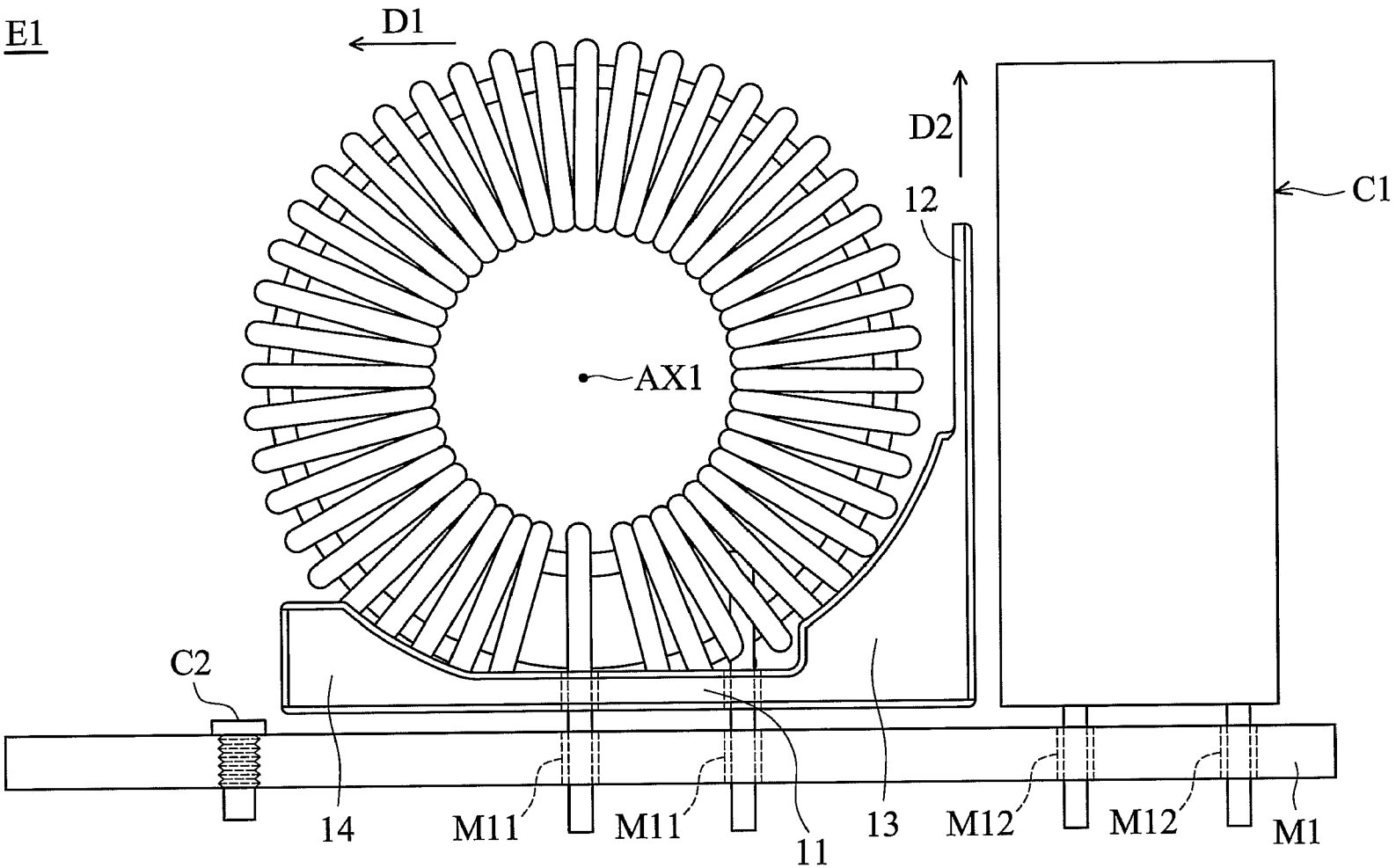
FIG. 5 is a schematic view of the inductor assembly of the invention disposed within an electronic device.

Please refer to FIG. 5, which is a schematic view of the inductor assembly 1 of the invention disposed within an electronic device E1. The electronic device E1 may be a power supply. The electronic device E1 includes an electronic component C1, a screw C2, and a printed circuit board M1. The electronic component C1 and the screw C2 are disposed on the printed circuit board M1. The printed circuit board M1 has mounting holes M11 and M12. The electronic component C1 may be a transformer. The inductor assembly 1 is mounted on the printed circuit board M1 via the mounting hole M11. As shown in FIG. 5, the mounting hole M11 of the inductor assembly 1 is very close to the mounting hole M12 of the electronic component C1. Because of circuit design and space planning of the electronic device E1, the relative locations between the electronic component C1, the screw C2, and the mounting holes M11 and M12 may not to be changed easily. Thus, the inductor component 20 may be very close to or be in contact with the electronic component C1.

However, by the structure of the base 10 of the embodiment, the inductor component 20 is more distant from the electronic component C1. Moreover, the spacing element 12 of the base 10 is located between the inductor component 20 and the electronic component C1, and the top portion of the spacing element 12 is higher than the axis AX1. Thus, the inductor component 20 is prevented from contact with the electronic component C1.

In conclusion, the spacing element of the inductor assembly is used for preventing the inductor component from contacting the electronic component. Moreover, the inductor component is more distant from the electronic component than the prior art because of the connecting element or the spacing element. Thus, the inductor component is apart from the electronic component at a safe distance.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inductor assembly, comprising:

a base comprising:

a base body having a first hole and a second hole;

a spacing element disposed on the base body;

a connecting element, connected to the base body and the spacing element, having a supporting surface on a top side thereof; and a carrying element, disposed on the base body, opposite to the connecting element; and an inductor component, disposed on the base body, close to the spacing element, wherein the inductor component is located upon and between the carrying element and the connecting element, and contacts with the supporting surface, wherein the first hole and the second hole are substantially located between the carrying element and the connecting element, and the inductor component comprises a wire element passing through the first hole and the second hole.

2. The inductor assembly as claimed in claim 1, wherein the second hole is located between the connecting element and the first hole.

3. The inductor assembly as claimed in claim 1 , wherein the inductor component comprises:

a magnetic core, wherein the wire element is wound on the magnetic core.

4. The inductor assembly as claimed in claim 1, wherein the inductor component has an axis lower than the top portion of the spacing element.

5. The inductor assembly as claimed in claim 1, wherein the inductor component has an axis substantially parallel to the base body and the spacing element.

6. The inductor assembly as claimed in claim 5, wherein the inductor component has an annular outer surface contacting with the connecting element and parallel to the axis.

7. The inductor assembly as claimed in claim 6, wherein the connecting element has a supporting surface contacting with the annular outer surface.

8. The inductor assembly as claimed in claim 1, wherein the carrying element has a carrying surface contacting with the inductor component.

9. The inductor assembly as claimed in claim 1, wherein the base includes two reinforcing ribs respectively disposed on two opposite edges of the base body and connected to the connecting element, wherein the inductor component is located between the reinforcing ribs.

10. The inductor assembly as claimed in claim 9, wherein the base includes an auxiliary reinforcing rib disposed between the reinforcing ribs.

* * * * *